US010246254B2

(12) United States Patent
Peterson et al.

(10) Patent No.: US 10,246,254 B2
(45) Date of Patent: Apr. 2, 2019

(54) COLLAPSIBLE WASTE RECEPTACLE

(71) Applicant: Ex-Cell Kaiser LLC, Franklin Park, IL (US)

(72) Inventors: Mary Peterson, Berwyn, IL (US); Kevin Gough, West Chicago, IL (US); Arkady Kantor, Buffalo Grove, IL (US); Charles Choi, Chicago, IL (US); Mark Pavel, Lisle, IL (US); Connor Brandt, Chicago, IL (US)

(73) Assignee: Ex-Cell Kaiser LLC, Franklin Park, IL (US)

( * ) Notice: Subject to any disclaimer, the term of this patent is extended or adjusted under 35 U.S.C. 154(b) by 112 days.

(21) Appl. No.: 15/281,802

(22) Filed: Sep. 30, 2016

(65) Prior Publication Data

US 2017/0275094 A1 Sep. 28, 2017

Related U.S. Application Data

(60) Provisional application No. 62/312,311, filed on Mar. 23, 2016.

(51) Int. Cl.

| | |
|---|---|
| ***B65D 41/56*** | (2006.01) |
| ***B65F 1/14*** | (2006.01) |
| ***B65F 1/16*** | (2006.01) |

(52) U.S. Cl.

CPC ..... *B65F 1/1415* (2013.01); *B65F 1/1607* (2013.01); *B65F 2210/1121* (2013.01); *B65F 2220/106* (2013.01)

(58) Field of Classification Search

CPC ..... B65F 1/141; B65F 1/1468; B65F 1/0066; B65F 1/0093; B65F 1/1415; B65F 1/062;

(Continued)

(56) References Cited

U.S. PATENT DOCUMENTS

| | | | |
|---|---|---|---|
| 524,259 | A | 8/1894 | Matthews |
| 1,274,800 | A | 8/1918 | Sketteno |

(Continued)

OTHER PUBLICATIONS

Ex-Cell Kaiser Manufacturing and Design Products Catalogue, 2015 Featured Products, p. 3, published date unknown, but prior to the filed of the persent application, Ex-Cell Kaiser LLC.

(Continued)

*Primary Examiner* — Fenn C Mathew
*Assistant Examiner* — Elizabeth J Volz
(74) *Attorney, Agent, or Firm* — Banner & Witcoff, Ltd.

(57) ABSTRACT

A collapsible waste receptacle is disclosed with front and rear frame pieces generally defining an exterior boundary. The waste receptacle is configured to move between an expanded and a collapsed configuration. In the expanded configuration, a bottom frame piece may be attached to both the front frame piece and the rear frame piece to define at least a lower portion of the exterior boundary of the receptacle, and a top surface may contact the front frame piece and the rear frame piece. To transition to the collapsed configuration, the bottom frame piece may disconnect and rotate to generally vertical orientation within the exterior boundary of the receptacle. The top surface may rotate around a frame piece to generally vertical orientation outside the exterior boundary. The front and rear frame pieces may move towards each other to define a collapsed configuration, e.g. assisted by the inward folding of remaining side panels.

20 Claims, 11 Drawing Sheets

(58) Field of Classification Search
CPC ..... B65F 1/068; B65F 1/1615; B65F 1/06; B65F 2220/1063; B65F 2220/11; B65B 67/12; B65B 67/1238; B65B 67/04; B65B 67/1233; B65B 67/1244; B65B 67/1255; A47B 43/00; A47B 55/02; A47F 5/01; A47F 5/10; A47F 5/13
USPC ... 220/9.1, 9.2, 9.3, 495.06, 495.08, 495.01, 220/494, 485, 489, 908, 908.1, 6, 4.28, 220/23.91, 666, 668; 248/95, 97, 99, 248/100; 211/195, 201, 149, 181.1
See application file for complete search history.

(56) References Cited

U.S. PATENT DOCUMENTS 1,422,797 A 7/1922 Sutherland
1,451,598 A 4/1923 Sutherland
1,653,393 A 12/1927 Cox
1,673,769 A 6/1928 Graham
2,475,797 A 7/1949 Martin
2,564,939 A 8/1951 Weast
2,780,381 A 2/1957 Coit
2,891,803 A 6/1959 Mintz
2,965,259 A 12/1960 Johnson
3,169,544 A 2/1965 Brown
3,260,488 A 7/1966 Kliewer et al.
3,896,766 A 7/1975 Martin
4,537,376 A 8/1985 Buku
4,549,748 A * 10/1985 Haley, Sr. ..... B62B 3/02 248/98
4,613,104 A * 9/1986 Garrott ..... B65B 67/1205 248/175
4,667,912 A 5/1987 DeVilbiss
5,169,101 A 12/1992 Wenzel et al.
5,323,921 A 6/1994 Olsson
5,363,980 A 11/1994 Mulcahy
5,464,237 A 11/1995 Saporiti
5,671,858 A 9/1997 Hsu
5,971,188 A 10/1999 Kellogg et al.
6,073,943 A 6/2000 Serrault
6,179,150 B1 * 1/2001 Fogler ..... B62B 1/14 220/485
7,748,798 B2 7/2010 LeTourneau et al.
8,256,443 B2 9/2012 Neal
8,342,461 B2 * 1/2013 Sutphen ..... B65F 1/06 220/212
2007/0108204 A1 5/2007 Warhurst et al.
2012/0037648 A1 * 2/2012 Goodman ..... A47G 19/30 220/668

OTHER PUBLICATIONS

Recycle Away Systems & Solutions Recycle Pro Customization Worksheet, p. 1-2, 2010.
Recycle Receptacle, Massachussetts Department of Corrections Unit, 2011.

* cited by examiner

COLLAPSIBLE WASTE RECEPTACLE

RELATED APPLICATION

The present application is a non-provisional application of U.S. Provisional Application No. 62/312,311, filed Mar. 23, 2016. The content of this application is incorporated herein by reference in its entirety for all purposes, and this application claims priority to the above noted Provisional Application.

TECHNICAL FIELD

Certain aspects of the disclosure relate to a collapsible receptacle, such as a receptacle for trash, refuse, compost, various recyclable materials, or a specific material to be disposed of or recycled.

BACKGROUND

Various types of waste receptacles are known. Many waste receptacles are designed to be permanent, for example utilizing concrete material and having a permanent shape defining a large interior cavity, and are therefore heavy and unwieldy to move. Temporary events such as concerts or festivals, however, often require the use of temporary waste receptacles. Currently, lighter, more portable waste receptacles, such as those made of plastic are unstable, and often require additional weight to combat being blown over by wind.

The additional weights make the set-up and removal of these receptacles cumbersome as well, as weights that are placed at the bottom of the receptacle (such as bricks) need to be found under refuse of other materials that are difficult and/or unpleasant to work through, or simply by requiring the placement and subsequent removal of other heavy materials around the waste receptacle (e.g. sand bags). What's more, plastic or other temporary receptacles are often not strong enough to allow repeated uses, nor an extended period of use, without breakage and/or taking on an aesthetically unpleasant appearance. In sum, the set-up, use, take-down and transport of current waste receptacles is often difficult, and storage of large quantities of these receptacles often requires a great deal of space.

SUMMARY

This Summary provides an introduction to some general concepts relating to this disclosure in a simplified form, where the general concepts are further described below in the Detailed Description. This Summary is not intended to identify key features or essential features of the disclosure.

In some embodiments, a waste receptacle may be configured to move between a collapsed configuration and an expanded configuration. The receptacle may include a front frame piece that defines a portion of an exterior boundary of the receptacle and a rear frame piece that defines a portion of an exterior boundary of the receptacle. The front frame piece and rear frame piece may include a plurality of wires. The front frame piece and rear frame piece may also define portions of two sides of an exterior boundary of the receptacle. The receptacle may include a bottom frame piece that can be attached to one or more wires of the front frame and/or the rear frame piece, and a top surface that is attached to at least a portion of the front frame piece and/or the rear frame piece.

The receptacle may include two side panels that span a distance between the front frame piece and the rear frame piece on the side boundaries of the receptacle. When transitioning from an expanded configuration to a collapsed configuration, the bottom frame piece may be detached from either the front frame piece or the rear frame piece and rotated inwardly into a vertical position and may be reattached to an upper portion of the front frame piece or rear frame piece. The top surface may be disconnected from either the front frame piece or rear frame piece and rotated about the other of the front frame piece or rear frame piece so that it is adjacent to an exterior boundary of the receptacle. The two side panels may be collapsed inwardly, so that the front frame and rear frame pieces may be brought towards each other to form a collapsed configuration, where the two side boundaries are smaller in the collapsed configuration than in the expanded configuration.

In other embodiments, a waste receptacle may be configured to move between a collapsed configuration and an expanded configuration, where the receptacle comprises a front frame piece defining a portion of an exterior boundary of the receptacle and a rear frame piece defining a portion of the exterior boundary of the receptacle. The receptacle may also include a bottom frame piece that may be releasably attached to at least a portion of the front frame piece, the rear frame piece, or both. The receptacle may also include a first side panel connecting a first side of the front frame and rear frame pieces and a second side panel connecting a second side of the front frame and rear frame pieces. The receptacle may also include a top surface attached to at least a portion of the front frame piece, the rear frame piece, or both, and the top surface may be configured to rotate about the attachment. When the waste receptacle is in the expanded configuration, the bottom frame piece may be in a first position where it is attached to both a bottom portion of the front frame piece and a bottom portion of the rear frame piece, such that the bottom frame piece defines at least a lower portion of a side boundary of the receptacle.

The two side panels may span a distance between the front frame piece and the rear frame piece to define a portion of two side boundaries of the receptacle, and the top surface may be in a first position where it is attached or adjacent to a top portion of the front frame piece and a top portion of the rear frame piece. When the receptacle is transitioned to its collapsed configuration, the top surface may be rotated outwardly from its first position to a second position where it is adjacent to the exterior boundary the receptacle. The bottom frame piece may be detached from the bottom portion of the front frame piece or the bottom portion of the rear frame piece, and may be pivoted inwardly about the attachment of the bottom portion of the frame piece to the other of the bottom portion of the front frame piece or the bottom portion of the rear frame piece, from its first position to a second position, and may be reattached in a vertical orientation to one or more top portions of the other of the front frame piece and rear frame piece. The two side panels may then be collapsed inwardly, such that the front frame and rear frame pieces may be brought towards each other along an axis between the front and rear frame pieces such that the two side exterior boundaries are smaller in the collapsed configuration than in the expanded configuration.

In further embodiments, a waste receptacle may be configured to move between a collapsed configuration and an expanded configuration. The receptacle may include a front frame piece that includes at least one wire defining a portion of an exterior boundary of the receptacle and a rear frame piece that includes at least one wire defining a portion of the exterior boundary of the receptacle. The receptacle may also include a bottom frame piece including at least one wire, where the bottom frame piece may be releasably attached to one or more wires of the front frame piece, the rear frame piece, or both. The receptacle may also include a first side panel connecting a first side of the front frame and rear frame pieces, and a second side panel connecting a second side of the front frame and rear frame pieces. The receptacle may include a top surface attached to at least a portion of one wire of the front frame piece, the rear frame piece, or both, and the top surface may be configured to rotate about the attachment when the waste receptacle is in the expanded configuration.

Also while in an expanded configuration, the bottom frame piece may be capable of being in a first position where it is attached to both the front frame piece and the rear frame piece, such that the bottom frame piece defines at least a lower portion of a side boundary of the receptacle. While in an expanded configuration, the two side panels span a distance between the front frame piece and the rear frame piece to define a portion of two side boundaries of the receptacle, and the top surface may be in a first position where it is attached or adjacent to any top wires of the front frame piece and rear frame piece. In some embodiments, when the waste receptacle is transitioned to its collapsed configuration, the top surface is rotated outwardly from its first position to a second position where it is adjacent to the exterior boundary of the receptacle.

The bottom frame piece may be detached from the one or more wires of the front frame piece or the rear frame piece, and may be pivoted inwardly about the attachment of the bottom frame piece to the other of the front frame piece and rear frame piece, from its first position to a second position, and may be reattached in a vertical orientation to one or more higher wires of the other of the front frame piece and rear frame piece. The two side panels may collapse inwardly, such that the front frame and rear frame pieces may be brought towards each other along an axis between the front and rear frame pieces such that the two side exterior boundaries are smaller in the collapsed configuration than in the expanded configuration.

In accordance with one example aspect of the disclosure, a waste receptacle may be configured to move between an expanded configuration and a collapsed configuration. The waste receptacle may comprise a front frame piece comprising a plurality of wires that may define a portion of an exterior boundary of the receptacle and a portion of two side boundaries of the receptacle. There may also be a rear frame piece comprising a plurality of wires that define a portion of an exterior boundary of the receptacle and a portion of two side boundaries of the receptacle.

The waste receptacle may further comprise a bottom frame piece that comprises a plurality of wires. The bottom frame piece may be configured to be releasably attached to one or more wires located on the front frame piece, the rear frame piece, or both. The waste receptacle may further comprise a first side panel connecting the first side of the front frame and the rear frame pieces, and may further comprise a second side panel connecting the second side of the front frame and the rear frame pieces. The waste receptacle may also comprise a top surface attached to at least a first portion of the front frame piece, the rear frame piece, or both. The top surface may be configured to rotate about the attachment to the front frame piece, the rear frame piece, or both.

The waste receptacle may be further configured such that when it is in an expanded configuration, the bottom frame piece is in a first position such that it is attached to at least a first portion of the front frame piece and at least a first portion of the rear frame piece. While in the expanded configuration, the bottom frame piece may define at least a lower portion of the two side exterior boundaries of the receptacle, and the two side panels may span the distance between the front frame piece and the rear frame piece on each side. Further, when the waste receptacle is transitioned into the collapsed configuration, the top surface may rotate along its attachment to the front frame piece, rear frame piece, or both, and may transition from a first position to a second position adjacent to the exterior boundary of the receptacle, where it may generally be parallel to the front frame piece and rear frame piece. While transitioning into the collapsed configuration, the bottom frame pieces may be detached from the one of more wires of the front frame piece or the rear frame piece, and may be pivoted from a first position to a second position where it remains in a generally vertical orientation. Finally, while transitioning into a collapsed state, the two side panels may collapse or deflect inward such that the front frame and rear frame pieces may be brought towards each other along an axis between the front and rear frame pieces.

In other embodiments of this disclosure, a waste receptacle may be configured to move between at least a first expanded configuration and at least a second collapsed configuration. The waste receptacle may comprise a first frame piece and a second frame piece. The first frame piece may comprise a plurality of wires and define a portion of an exterior boundary. The second frame piece may comprise a plurality of wires, and may also define a portion of an exterior boundary. The first and second frame piece may be connected by two side panels. The side panels may be configured to collapse inward when the first frame piece and second frame piece are moved towards each other. The waste receptacle may further comprise a bottom frame piece. The bottom frame piece may be a single wire or plurality of wires and may be configured to attach to one or more of the first frame piece or second frame piece.

When the waste receptacle is in an expanded configuration, the bottom frame piece will be coupled with one of the first or second frame piece and removably attached to the other of the first or second frame piece, and will be generally oriented perpendicularly to both the first and the second piece. While transitioning to the collapsed configuration, the bottom frame piece may be detached from the first or second frame piece to which it is removably attached, and may be rotated about the first or second piece to which it is coupled, such that it will remain in a generally vertical orientation located inside the exterior boundaries defined by the first and the second frame piece. While the bottom frame piece is in a generally vertical orientation, the first frame piece and the second frame piece may be configured to move towards each other such that the internal volume defined by the exterior boundaries is greatly reduced.

In other embodiments of this disclosure, a waste receptacle may be configured to be selectively altered between an expanded configuration and a collapsed configuration. The waste receptacle may comprise a first frame piece, a second frame piece, a bottom frame piece, at least a first side panel, and a top surface. The first frame piece and the second frame piece may comprise a plurality of wires, and be oriented generally parallel to each other such that they define a front and a rear exterior boundary of the waste receptacle.

The at least first side panel may define at least an upper portion of at least a first side boundary and be configured to collapse inwardly when the waste receptacle is in a collapsed configuration. While in the expanded configuration, the bottom frame piece may be removably coupled to at least a first wire of the first frame piece and a first wire of the second frame piece, and may generally define at least a first side boundary of the waste receptacle. The bottom frame piece may be configured to be disconnected from at least one of the first frame piece or the second frame piece such that it may then be pivoted about the remaining frame piece to which it is removably coupled.

The top surface may be removably coupled to at least one of the first frame piece or the second frame piece, and may be selectively altered between a first position and a second position, such that in the first position the top surface may be in contact with both the first frame piece and the second frame piece in a way that defines a top external boundary of the waste receptacle, and further such that in the second position the top surface may be pivoted about its removable attachment to the first frame piece or the second frame piece and may be oriented in a general vertical position outside the external boundaries of the waste receptacle. While the bottom frame piece and the top surface are both in their second position, the first frame piece and the second frame piece may be moved together along the axis between them such that the side panels collapse inwardly and the internal dimensions of the waste receptacle are reduced.

BRIEF DESCRIPTION OF THE DRAWINGS

Example embodiments of the disclosure will now be described by way of example only and with reference to the accompanying drawings, in which.

The figures of this disclosure may represent the scale and/or dimensions according to one or more embodiments, and as such contribute to the teaching of such dimensional scaling. However, the disclosure herein is not limited to the scales, dimensions, proportions, and/or orientations shown in the figures.

DETAILED DESCRIPTION OF EMBODIMENTS

In the following description of various examples of this disclosure for embodiments of a collapsible waste receptacle, reference is made to the accompanying drawings, which form a part hereof. It is to be understood that other modifications may be made from the specifically described embodiments without departing from the scope of the present disclosure.

The embodiments described herein provide, in some aspects of the disclosure, apparatuses relating to collapsible waste receptacles or collapsible containers. These and other aspects, features and advantages of the disclosure or of certain embodiments of the disclosure will be further understood by those skilled in the art from the following description of example embodiments.

These apparatus descriptions are merely examples. In certain embodiments, the apparatus may comprise additional combinations or substitutions of some or all of the components described herein. Moreover, additional and alternative suitable variations, forms and components for the apparatus will be recognized by those skilled in the art given the benefit of this disclosure. What's more, any of the features disclosed in the discussion of one embodiment may be features of any other embodiments disclosed within even when not specifically discussed.

Figure 1:
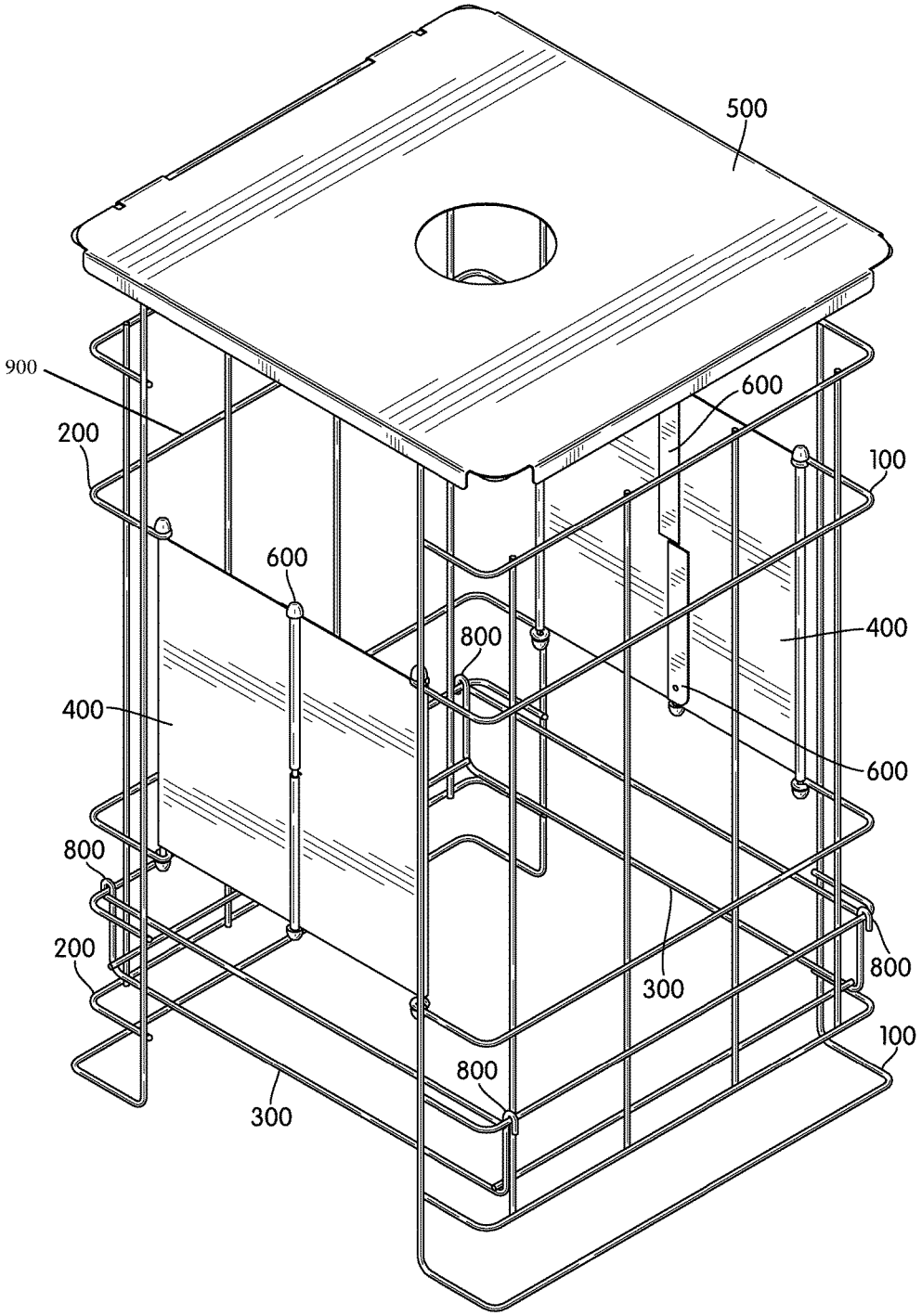
FIG. 1 is a perspective view of a waste receptacle embodiment in an expanded configuration.
Figure 2:
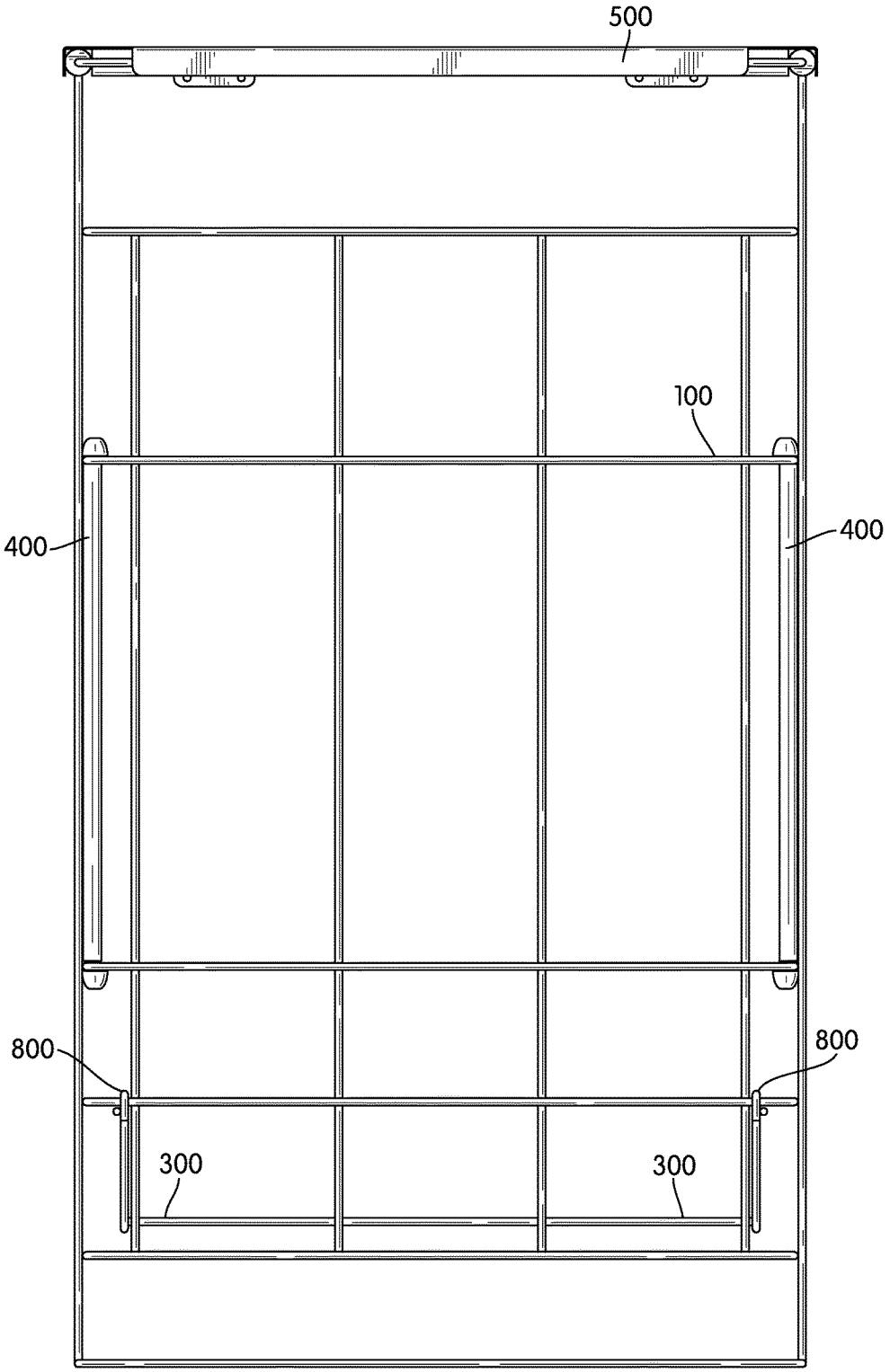
FIG. 2 is a front view of a waste receptacle embodiment.
Figure 3:
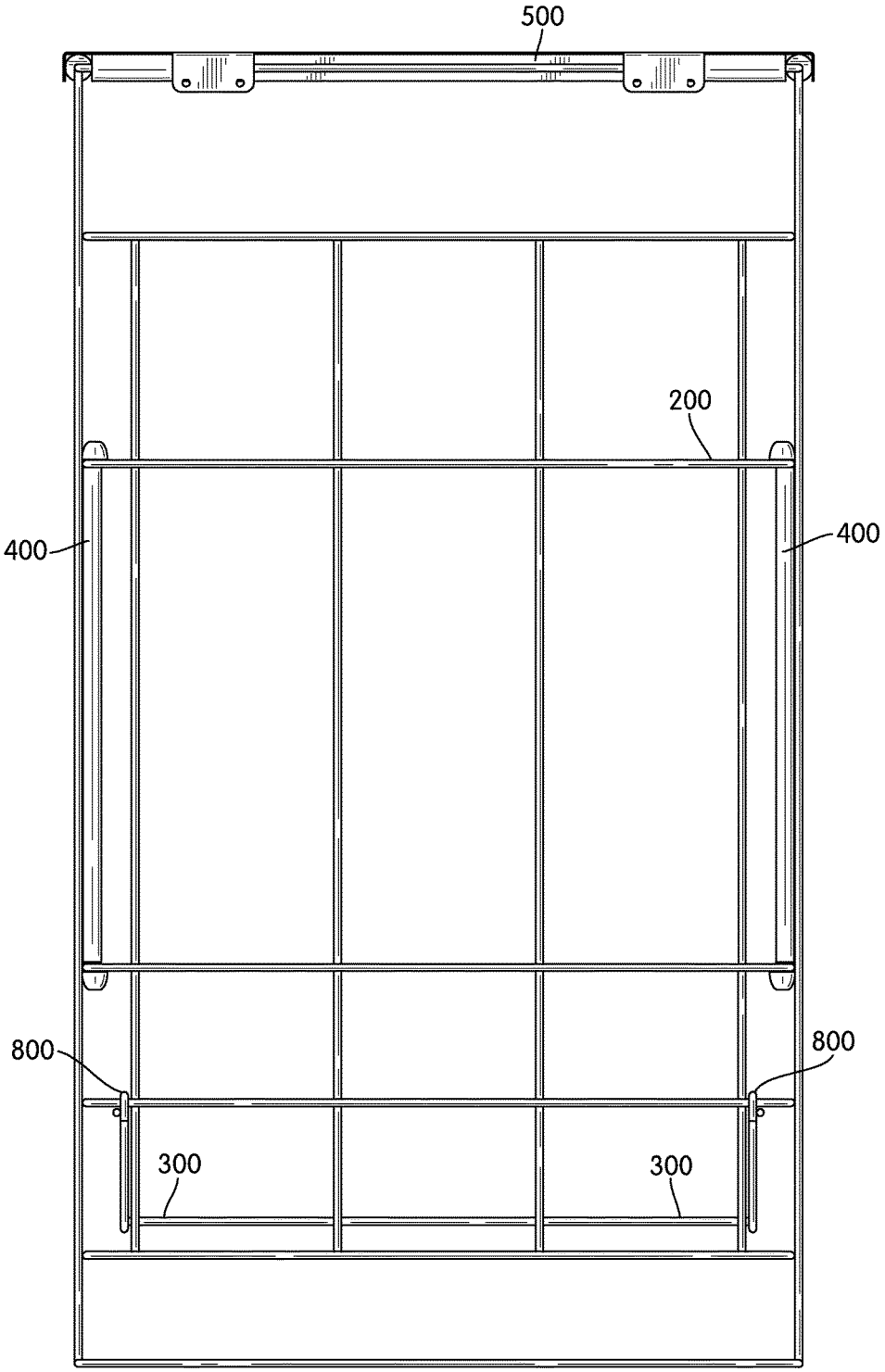
FIG. 3 is a rear view of a waste receptacle embodiment.
Figure 4:
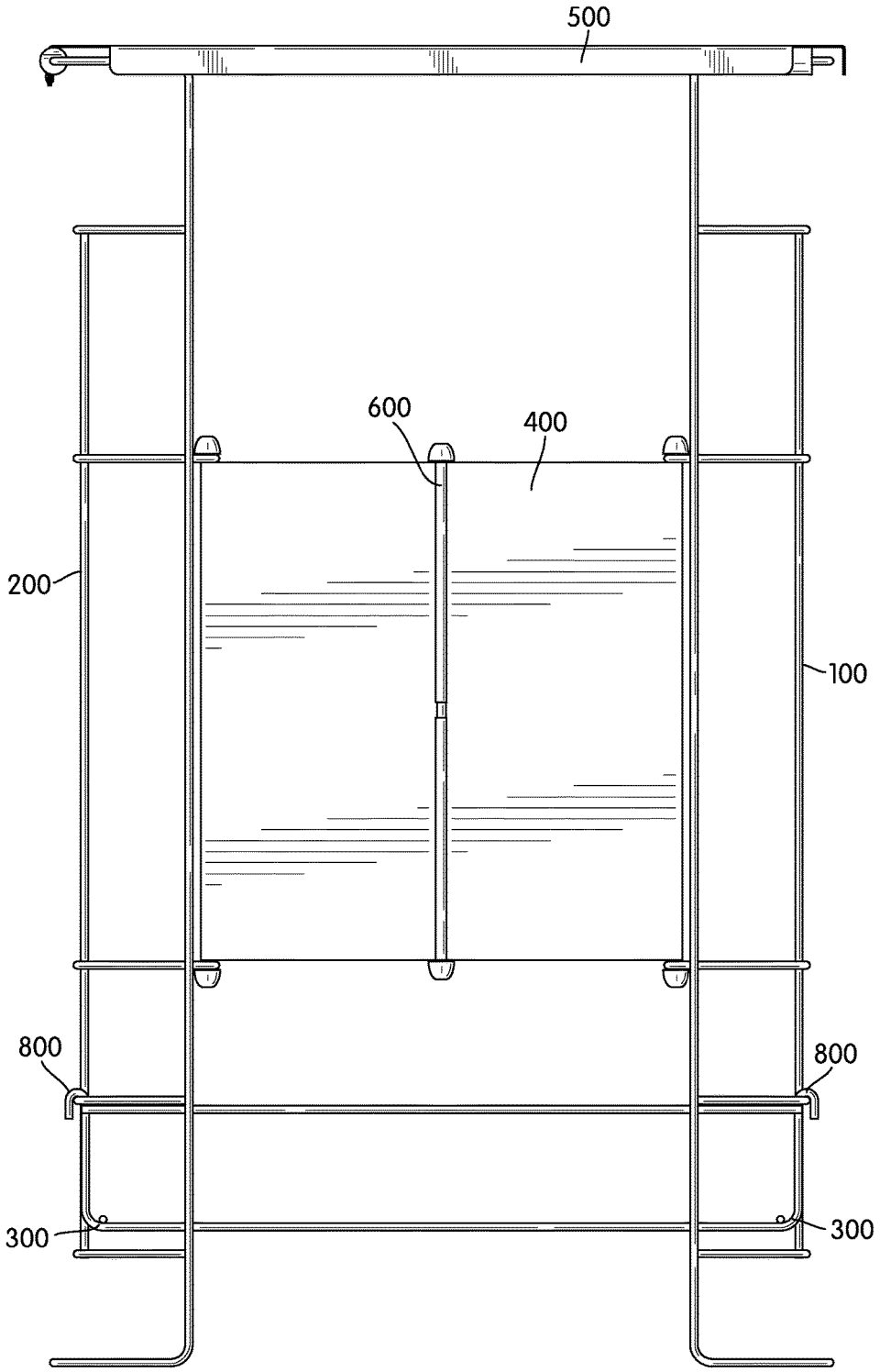
FIG. 4 is a side view of a waste receptacle embodiment in an expanded configuration.
Figure 5:
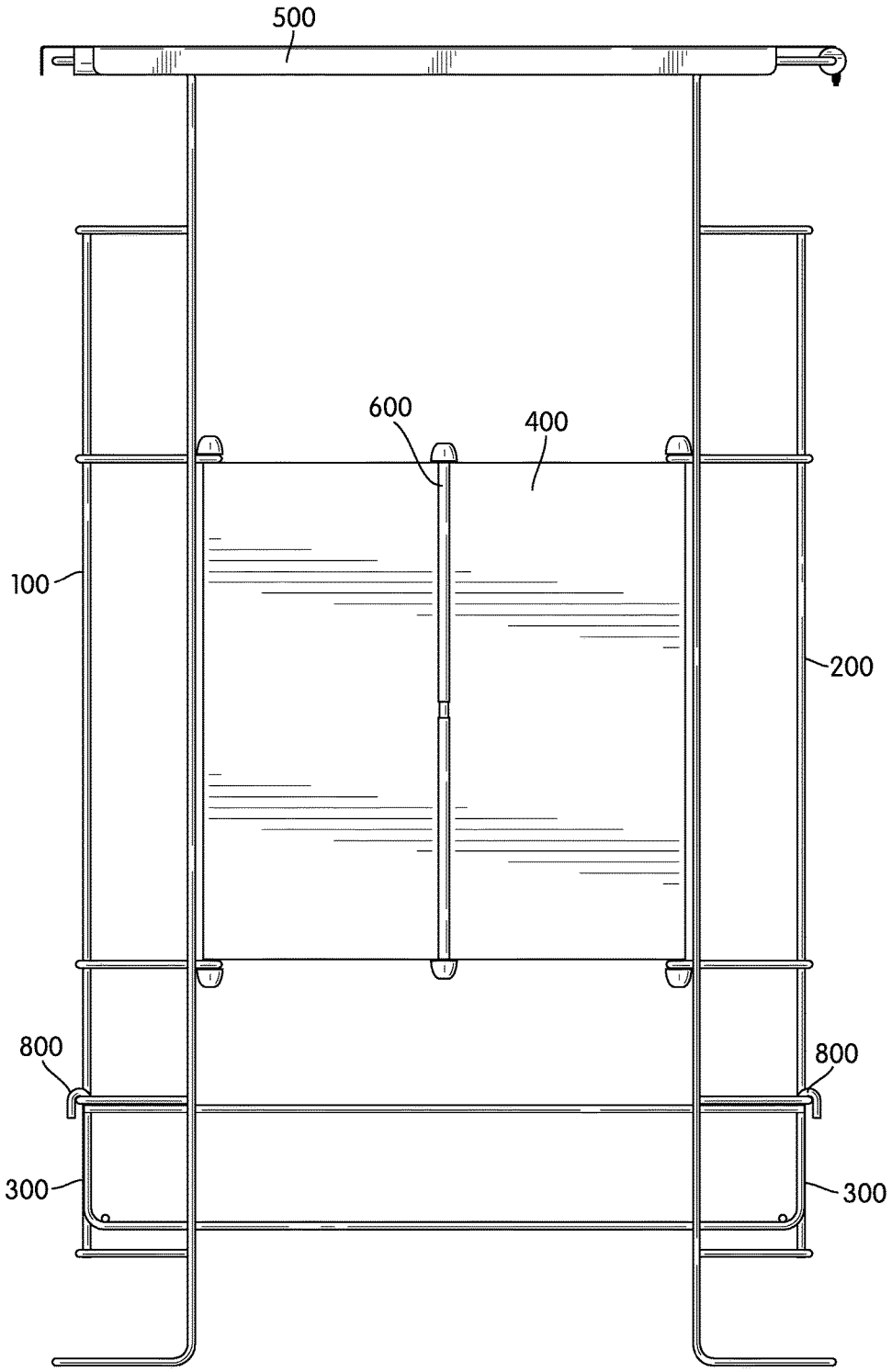
FIG. 5 is another side view of a waste receptacle embodiment in an expanded configuration.

FIG. 1 shows an example embodiment of a collapsible waste receptacle. As shown in FIG. 1, in certain embodiments the waste receptacle will generally have a front frame piece 100 and a rear frame piece 200. In some embodiments the front frame piece may comprise a single wire, for example a single wire that translates through one or more planes to provide vertical, horizontal, diagonal, curved, and/or other lines of material to at least partially define an exterior boundary, and in other embodiments may comprise a plurality of wires (e.g. one or more vertical wires, and/or horizontal wires, and/or diagonal wires, and so on). For example, in the embodiment shown in FIG. 1 the front frame piece includes four vertical wires in the front boundary, and seven horizontal wires that intersect at least some of the vertical wires. Other numbers and configurations are suitable, however. The wire or wires may comprise one or more metals or metallic alloys (e.g. aluminum, steel, titanium, iron, or alloys thereof) or other materials such a thermoplastic, thermoresin, a composite material, and maybe further include a coating, such as a paint, thermoset coating, or other powder coat.

In certain embodiments the front frame piece 100 may generally define a front exterior boundary of the waste receptacle. As shown in FIG. 1, in some embodiments the front frame piece may also define a portion of two side exterior boundaries of the receptacle. In different embodiments this side portion may be equal to a third of each of the side exterior boundary's length or less, a fourth of the side exterior boundary's length or less, and other variations of a portion of the side exterior boundary (e.g. approximately 20% or less, about 15-25%, about 20-25%, about 15-20%, about 18-20%, approximately 15% or less, approximately 10% or less). In some examples, this portion may define approximately five inches of the length of the side boundary when the receptacle is expanded, when the total expanded length is approximately 22 inches (or use a similar ratio with different dimensions).

In certain embodiments the front frame piece may generally define a rectangular exterior front boundary (and in some examples, the overall exterior boundary may be a generally rectangular three dimensional shape), but in further embodiments the front frame piece may define a boundary that is generally and/or predominantly ellipsoidal, circular, square, triangular, another geometric shape, or irregular in shape. In certain examples, the frame pieces of the receptacle may comprise other materials, such as surfaces, webs, cross-hatch patterns, or strips of material spanning certain distances (where these may comprise the same materials as the wires, or may be distinct materials). In other examples, the frames do not comprise wires, but other materials that provide the features described herein, such as narrow strips of material.

In certain embodiments the rear frame piece 200 may comprise a single wire (which may have the same characteristics described above), and in other embodiments may comprise a plurality of wires. The rear frame piece may be identical or similar to the front frame piece outside of its placement and orientation. In certain embodiments the rear frame piece 200 may generally define a rear exterior boundary of the waste receptacle. As shown in FIG. 1, in some embodiments the rear frame piece may also define a portion of two side exterior boundaries of the receptacle. In different embodiments this portion may be equal to a third of the side exterior boundary's length or less, a fourth of the side exterior boundary's length or less, and other variations of a portion of the side exterior boundary (e.g. approximately 20% or less, about 15-25%, about 20-25%, about 15-20%, about 18-20%, approximately 15% or less, approximately 10% or less). In some examples, this portion may define approximately five inches of the length of the side boundary when the receptacle is expanded, when the total expanded length is approximately 22 inches. In certain embodiments the rear frame piece may generally define a rectangular exterior front boundary, but in further embodiments the rest frame piece may define a boundary that is generally and/or predominantly ellipsoidal, circular, square, triangular, another geometric shape, or irregular in shape.

In some examples, the number of wires defining the front frame piece and the rear frame piece are minimized where possible to lower the weight of the waste receptacle and improve portability. At the same time, however, the wire structure of the front frame piece and the rear frame piece (alone or in combination with other components of the receptacle) may still provide enough mass to provide stability from toppling, including from wind or other forces that the receptacle may encounter. For example, the receptacle may be approximately 21 pounds with all components included. In other examples, the receptacle is approximately 20-25 pounds, approximately 15-30 pounds, or approximately 18-23 pounds. In some examples, the receptacle weighs 25 pounds or less, 30 pounds or less, 15 pounds or more, or 20 pounds or more. In different embodiments the weight of the waste receptacle greater than 18 pounds, or less than 28 pounds.

In some examples, the wire structures are strategically positioned and shaped so as to allow the waste receptacle to collapse, but also to prevent trash and the trash bags from coming out of exterior boundaries of the waste receptacle (when expanded) and/or tearing during removal by excessive contact with weld points between wires or portions of wires (in some examples, there are 20 weld points or less on the front and rear boundaries, and in others, 25 or less, 30 or less, 15 or less, or between 18 and 25). For example, in some embodiments, the receptacle (in the boundaries defined by wire frames) has at least one wire within a certain distance of any point of the exterior boundaries (e.g. the generally rectangular exterior shape illustrated in FIG. 1), such that no large "gaps" are present—for example a wire within three inches of any point, within four inches, within two inches, and so on. In some examples, relatively larger gaps may be present in the middle portions and relatively smaller gaps are present on the outer portions of frame pieces and/or boundaries. In some examples the ground may act as a "boundary" in lieu of an additional wire, or in conjunction with another wire(s)). In other examples, the frames may comprise additional materials connected to or spanning distance between wires that prevent escape/overflow.

Additionally, in some examples the wire structures are numbered, positioned, and have characteristics that allow a user to view into the waste receptacle and/or view a trash bag contained therein (e.g. a partially transparent or translucent trash bag), providing additional visibility and assisting with potential safety issues from unidentifiable objects in the waste receptacle or a waste bag contained therein. In certain examples, less than 10% of the total area of the front and/or rear boundaries is obscured by wires or other materials. In some examples, 7.5% or less is obscured, or 15% or less, or even 5% or less.

As shown further in FIG. 1, in some embodiments the waste receptacle may have a bottom frame piece 300. The bottom frame piece may comprise a single wire or a plurality of wires, as with other frame pieces, or may have a different composition, such as a solid plastic piece or metal piece having a continuous surface. In some examples, the bottom frame piece, while in the expanded configuration of the receptacle, may have a bottom edge and/or wire that is located at least some distance off/above the ground or surface the receptacle is placed on. In certain embodiments the bottom frame piece will be located on both sides of receptacle and span the distance between the sides, but in further embodiments the bottom frame piece will be located on only one side of the receptacle. When in the expanded configuration, the bottom frame piece may define at least a lower portion of an exterior side boundary of the receptacle (or both side boundaries), although this does not have to include the bottom edge of the side boundary (e.g. in FIG. 1, the bottom frame piece defines a lower portion of the side boundary, but the side portions of the front and rear frame pieces define at least in part relatively lower portions of the same side exterior boundary).

While in the expanded configuration shown in FIG. 1, in some embodiments the bottom frame piece may be coupled to a wire or wires of the front frame piece and be configured to be removably attached to a wire or wires of the rear frame piece. In others it is permanently attached on one side and is configured to hinge or pivot about one of the wires or another part of the front or rear frame piece. Depending on the size and shape of the bottom frame piece, and its location of attachment (whether removable or permanent), the rotation and/or pivoting from one position to another may be outwardly or inwardly. For example, the embodiment illustrated in FIG. 1, the bottom frame piece rotates inwardly. But in some examples, the rotation may be outward. For example, the rotation may be about a bottom wire or bottom section, or the front and/or rear piece has a gap in the bottom edge wires designed to be in contact with the ground (or other surface) such that the bottom piece may be rotated through (e.g. the bottom frame piece may have central wires/pieces designed to go through a gap, and then outwardly extending wires/pieces that provide a side boundary that can pass under the corners of the receptacle). In still other examples, the bottom frame piece can simply be removed entirely and then reattached at some other portion of the receptacle (e.g. the interior or exterior surface of the front or rear piece).

As one example, the bottom frame piece may comprise one or more hook features or other coupling features (such as the hooks 800 shown in some figures) that can couple to another wire piece when, e.g., guided and placed over another appropriately positioned wire. In further embodiments, the bottom frame piece may be coupled to a wire or wires of the rear frame piece and be configured to be removably attached to a wire or wires of the front frame piece. In certain embodiments the bottom frame piece may be removably coupled to the both the front frame piece and the rear frame piece, such that a user may choose whether to detach the bottom frame piece from either the front frame piece or the rear frame piece and rotate the bottom frame piece around whichever frame piece to which the bottom frame piece is still removably attached, or even remove it entirely. In certain embodiments, this removable attachment may occur through a mechanical retaining structure, such as a hook, tab, correspondingly shaped fingers/projections and cavities, and the like.

Figure 8:
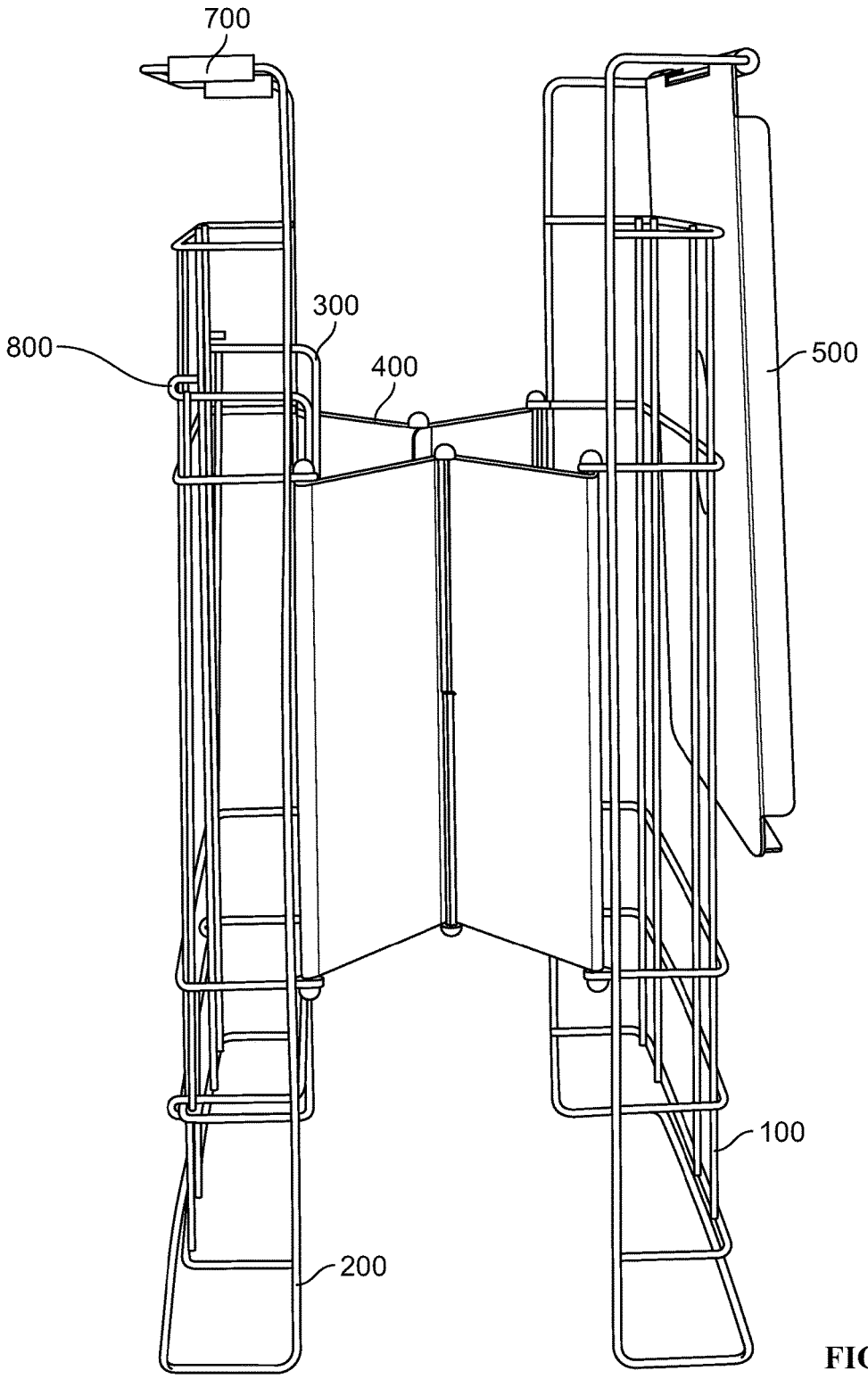
FIG. 8 is a perspective view of a waste receptacle embodiment transitioning between an expanded configuration and a collapsed configuration.
Figure 9:
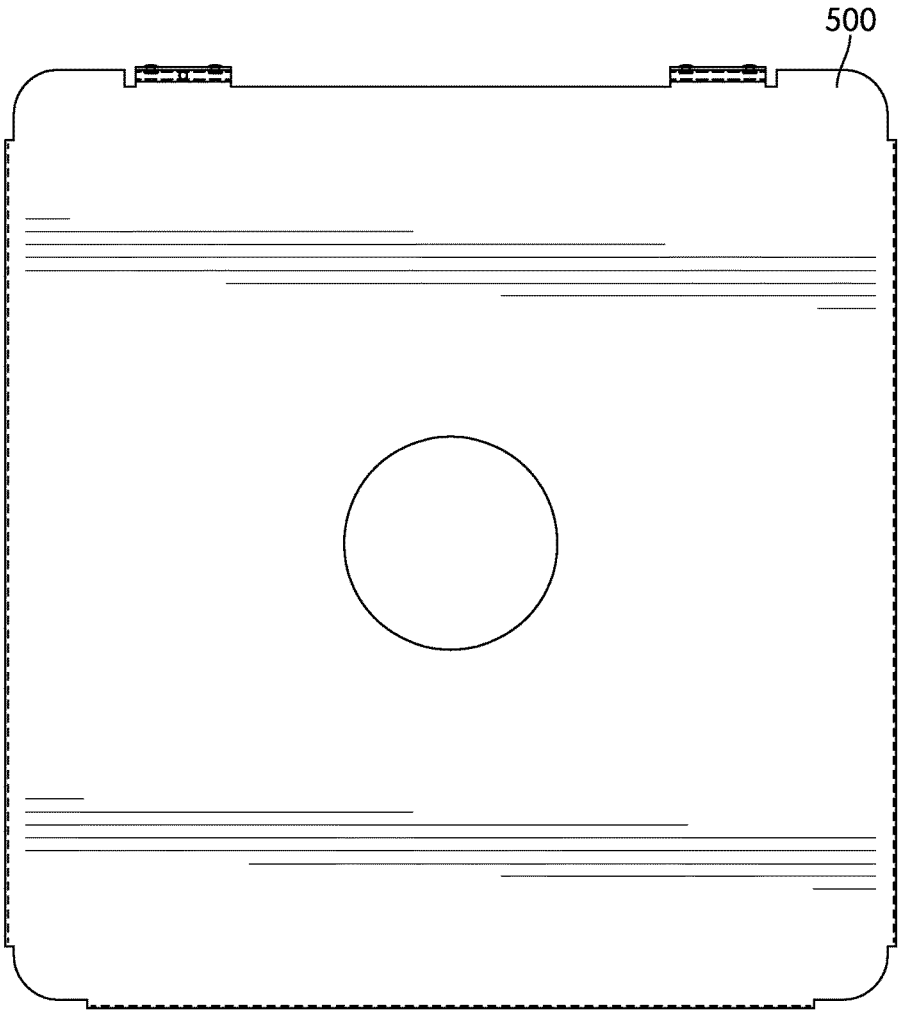
FIG. 9 is top view of a top surface embodiment.
Figure 10:
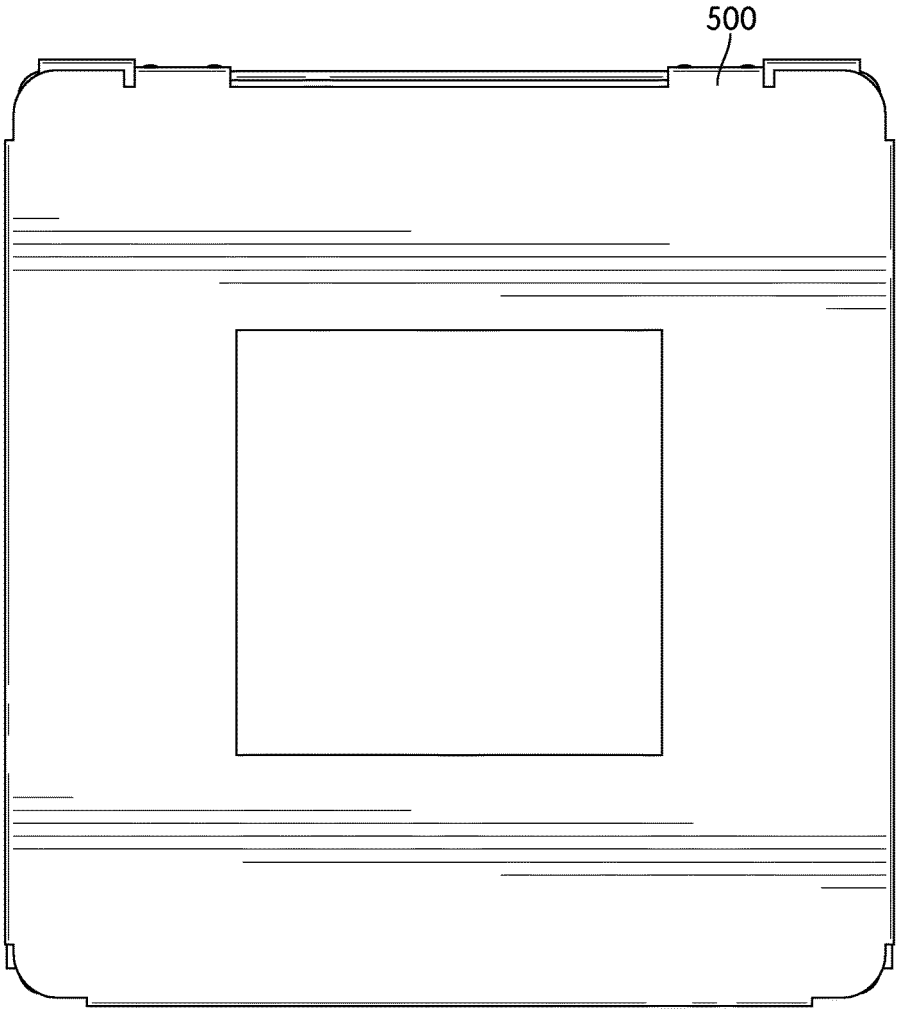
FIG. 10 is a top view of another top surface embodiment.
Figure 11:
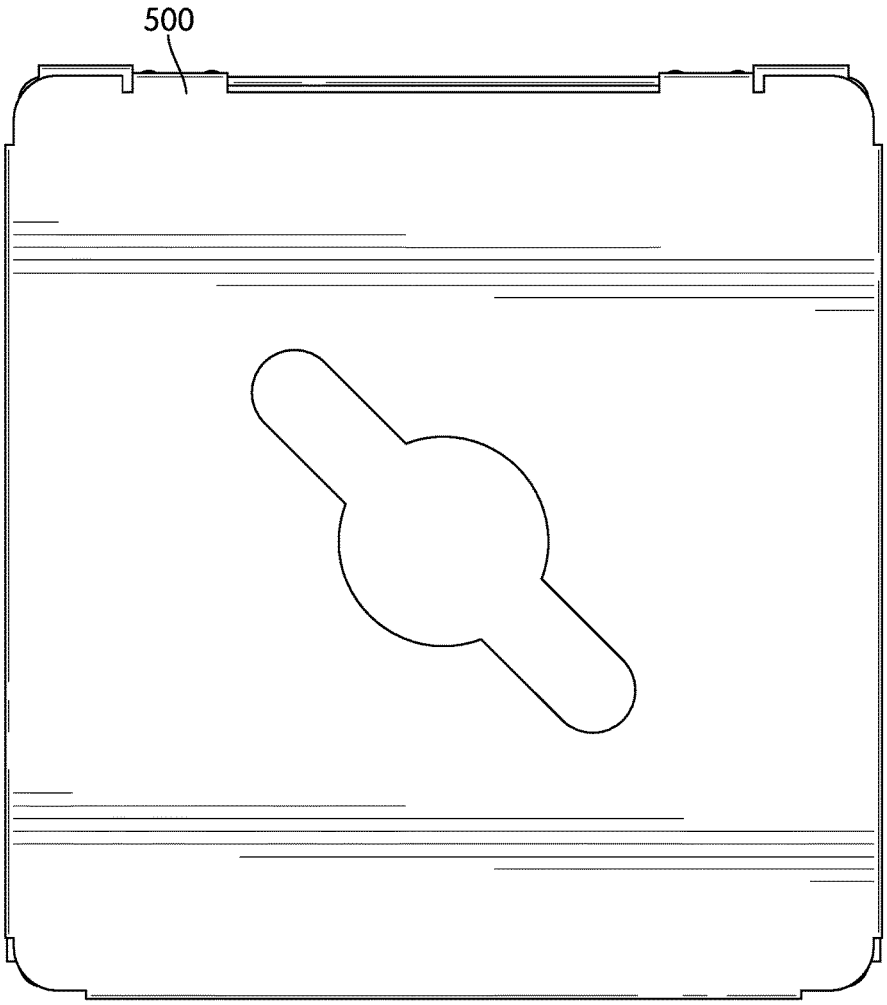
FIG. 11 is a top view of a further top surface embodiment.

In certain embodiments the bottom frame piece may be configured to be detached from the one or more wires of the front frame piece or rear frame piece that it is removably attached to, and may then be rotated about the frame piece to which it is still coupled. As shown in FIG. 8, the bottom frame piece may be rotated until it is in a generally vertical orientation. In some embodiments the bottom frame piece may be configured to then be removably coupled to an upper portion and/or intermediate portion of the front frame piece or the rear frame piece, whichever frame piece it was rotated about, and therefore securing it in the vertical position.

Figure 7:
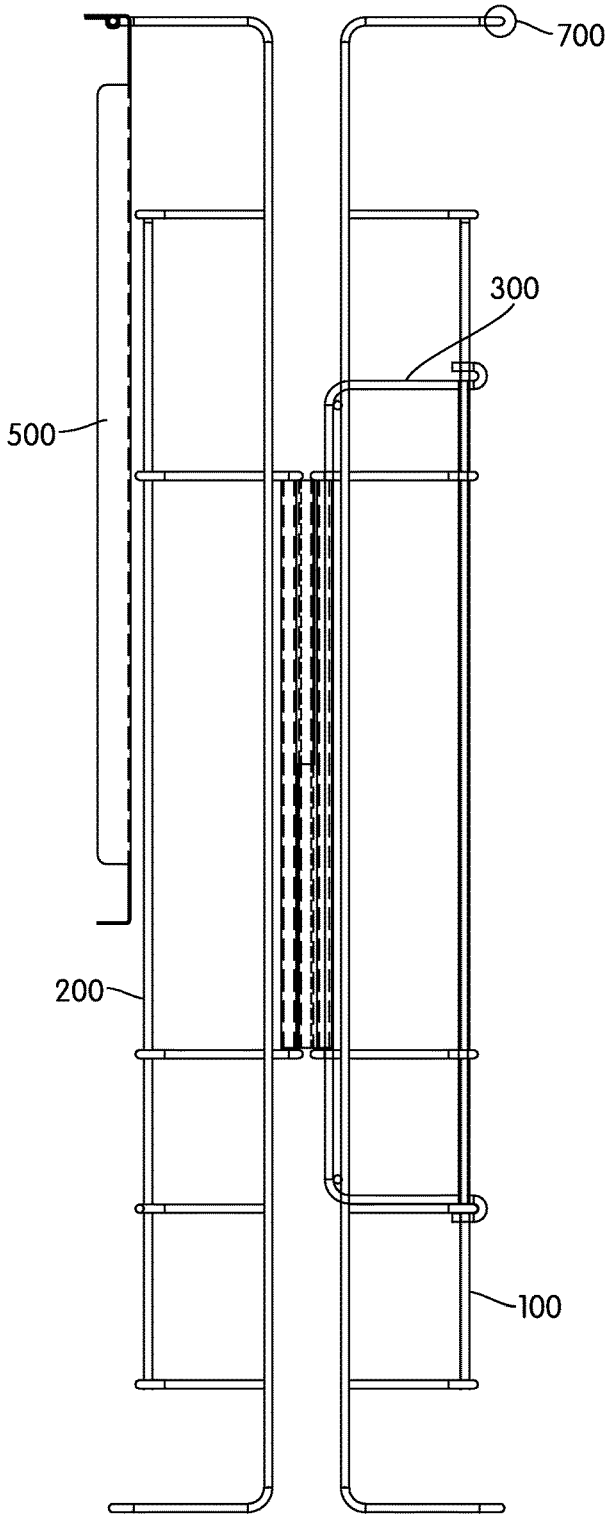
FIG. 7 is a side view of a waste receptacle embodiment in a collapsed configuration.

In further embodiments the bottom frame will not be configured to be removably coupled to an upper portion of whichever frame piece it was rotated about, but may still be capable of remaining generally secure in its position. In some examples, when the bottom piece is in the vertical orientation, its width is approximately equal to the width of the front and/or rear frame pieces that define the portion of the side boundaries. In other embodiments, it is slightly less or more than this width (e.g. within 10%), or even smaller in comparison to the side dimension of the front/rear pieces. As one example, in FIG. 7, the width of the vertically orientated bottom frame piece (e.g. as established by the wire that was the bottom-most wire of the bottom piece when in the expanded configuration, and is now the inner-most wire) extends just beyond the edge of the side portion of the front frame piece, such that the front and rear pieces may be moved toward each other to achieve the collapsed position. In other examples, it extends just beyond the rear frame piece, or may be placed near either frame piece, selectively, by the user.

Figure 6:
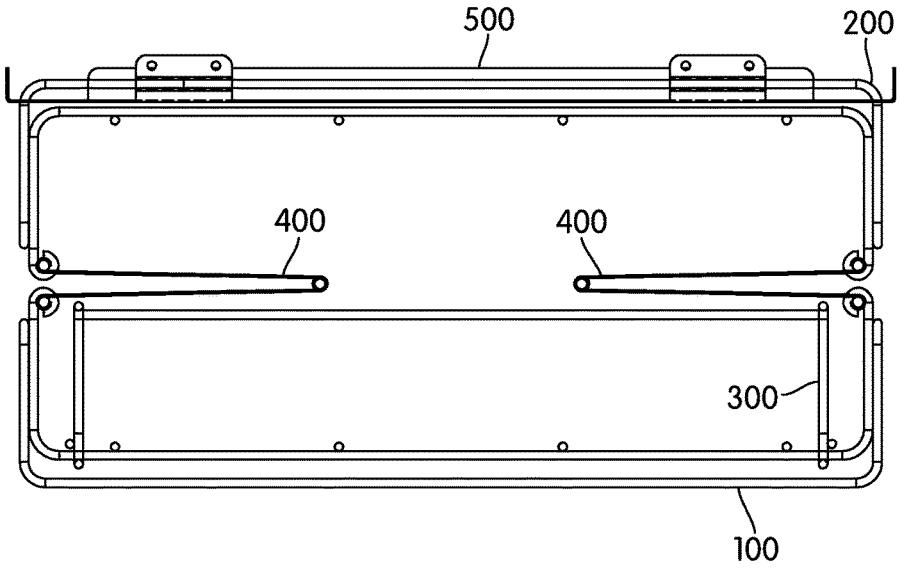
FIG. 6 is a top view of a waste receptacle embodiment with the top surface removed.

In some embodiments the side exterior boundaries may be further defined by side panels 400. In some embodiments the side panels may also further define one, or both, of the side exterior boundaries when the receptacle is in the expanded configuration. In certain embodiments, while in an expanded configuration the side panels may be generally perpendicular to the front frame piece and rear frame piece. In certain embodiments the side panels may consist of a single panel with a hinge in the middle capable of collapsing inward, such that as the front frame piece and rear frame piece are brought together, the two portions of the panel on either side of the hinge are capable of rotating inward towards each other until they are orientated generally parallel to the front frame piece and the rear frame piece, as shown in FIG. 6.

In further embodiments, the side panels may comprise multiple panels connected by a hinge, or may comprise or consist of a flexible or pliable material (that may be periodically ribbed or reinforced with a stronger, or less flexible material), or have sections of such a material. In different embodiments, the side panels may comprise any structure capable of collapsing inward from a first position in an expanded configuration to a second position in a collapsed configuration. In some examples, the side panels are attached to the frame pieces through or in connection with a hinge that facilitates rotation of the outer portions of the side panels. For example, a hinge pin or other hinge component may be connected to a wire(s) or wire portions, and the side panel edges enclose or are otherwise connected to the hinge pin or component.

In some embodiments the side panels 400 may comprise a plastic material, including but not limited to polypropylene, another synthetic plastic polymer such as polycarbonate or polyvinyl chloride, metal or a metallic alloy, or a combination of such materials. This material may have sufficient rigidity characteristics such that it may withstand wind without potentially folding outward with respect to the front frame piece and the rear frame piece. The design of the side panels may also allow for the addition of displays, such as decals, painting, stickers, etc., to act as an identifier (these indicia may be present on other surfaces as well, or in place of their presence on the side panels, such as on the top surface). For example, displays may be added to the side panels to allow users and custodians to easily identify what type of receptacle it is, such as recycling for cans or bottles, paper, or trash. In some examples, the side panels include back flaps (e.g. flaps 600 of certain figures) that extend onto a portion of an adjacent piece of the side panel, to help prevent relative movement in an undesired direction.

In some examples, there are no wires between the side panels and the top surface of the receptacle (outside of any wires used to secure the side panels or otherwise directly attached to the side panels). In certain examples, with the exception of the bottom frame piece, there are no wires between the side panels and ground or other surface that the receptacle is placed (outside of any wires used to secure the side panels or otherwise directly attached to the side panels). In certain examples, the side panels cover approximately one third or less of the height of the receptacle, about one half or less of the height, about 35-45% of the height, about 30-50% of the height, or about 60% or less of the height. In some examples, there may be multiple side panels, such as two or more sets of side panels (e.g. each with a smaller height compared to the example side panels of FIG. 1), a plurality of hinged strips, or a combination thereof. In certain examples, the surfaces of a side panel or multiple side panels may comprise other features such as apertures, ridges, or may be partially or entirely coated with an additional material.

In further embodiments the waste receptacle may further comprise a top surface 500, shown in FIG. 1 (and others). In certain embodiments this top surface may be a rectangular shape, but may also be circular, square, or irregular in shape (or otherwise comprise to the shape defined by the top portion of any frame pieces). In some embodiments the top surface may be removably and/or rotationally coupled to at least one of the front frame piece or the rear frame piece. In further embodiments the top surface may be configured to be selectively altered between a first position and a second position. The may be done be inward or outward rotation, or by selective detachment and reattachment. In some embodiments the first location of the top surface may be such that the top surface is removably coupled to one of the first frame piece or the second frame piece, and positioned generally perpendicularly to both the first frame piece and the second frame piece such that it is in contact with the other of the first frame piece or the second frame piece to which it is not removably coupled. In further embodiments the top surface may be coupled to one of the first frame piece of second frame piece such that it is not removable. In some embodiments this removable coupling may occur through mechanical means such as hooks, snaps, tabs, etc. In certain examples, the top surface includes a flat surface and one or more lips or flanges extending from that surface. The top surface may be any suitable materials, such as a plastic, metal, metallic alloy or a combination thereof.

In certain embodiments the top surface may have a structure, such as a lip or flange, such that when it is in the first position and in contact with one of the first frame piece or second frame piece, or a component attached to the frame piece such as a grip pieces or frictional materials or gaskets, it does not become removably coupled but does create a frictional connection such that the top surface may not easily move. In some embodiments, as the top surface is altered from a first position to a second position it will be rotated around the frame piece to which it is removably coupled or coupled (for example, in the example of FIG. 8, the top surface is attached via riveted flanges that are connected to a top wire of a frame piece).

In some examples, the top surface includes a clip, or is connected via a clip attached to a frame piece, or is connected via corresponding mechanical components (e.g. a tab and groove configured to be positioned adjacently when the top surface is closed). As shown in FIG. 8, in certain embodiments, as the top surface is rotated, it will be configured to rest in a position adjacent to and generally parallel to whichever frame piece it was rotated around, such that the top surface is located outside the exterior boundaries of the waste receptacle. In certain embodiments, as the top surface is in a second position it may allow the first frame piece and the second frame piece to be moved towards each other along an axis such that the waste receptacle may be converted to a collapsed configuration.

As shown in FIG. 1, the top surface may have an opening such that when a trash bag is inserted into the interior of the expanded configuration of the waste receptacle and the top surface is in its first position, it may still allow access into the interior of the waste receptacle. In different embodiments this opening may be generally circular, rectangular, square, or any other shape allowing access into the interior of the waste receptacle. The opening may also comprise one or more slots, or a combination of a slot and another shape. For example, a circular (or square) hole may have slots extending out of one or more sides (such as two opposing sides) so that wider objects, such as papers, may be easily placed in the receptacle. In some examples, one or more slots may be on the sides or other portions of the top (as compared to the location(s) of relatively larger hole/aperture, or multiple hole/apertures, or only slots of various sizes may be used) to provide ancillary waste receiving capabilities, such as for a receptacle configuration to accept trash in one portion and recycling materials in another (where in this and another examples, multiple bags, containers, or other objects may be placed in the expanded receptacle to receive the appropriate kinds of waste. In other examples, one or more bags are placed in the receptacle such that it may be collapsed, and therefore is ready for use once it is expanded.

In some embodiments the top surface may further comprise one of more gaskets that aid in securing a trash bag in the interior of the waste receptacle. In other embodiments the one or more gaskets (e.g. gaskets 700 of certain figures) may be located on the first frame piece, the second piece, or both (for example, in some embodiments, the top portions of the frame have four total gaskets, where one is generally located in each corner, as illustrated in, e.g. FIG. 8), and may further aid in securing a trash bag in the interior of the waste receptacle. The gaskets may be placed on the top portions of the frames, as illustrated in the Figures and/or may be on other locations on the bottom or intermediate sections of one or more frame pieces. As an example of one such location, location 900 of Figure may include a gasket, as well as the corresponding section on the other side of the back frame piece (or the middle of the same horizontal wire, and/or other locations on other horizontal or vertical wires), and/or similar locations on the front frame.

For example, the trash bag may be placed on the outside or wrapped around the gasket, and then the top surface is closed of the gasket to secure the top surface and pin the trash/waste bag therebetween. The gaskets may be rubber or comprise rubber, or some other material providing a high coefficient of friction relative to the top surface (or a portion(s) thereof such as a lip, flange, etc.) and/or the wires. In certain embodiments the gaskets will be strategically located to provide as much stability to the trash bag as possible (e.g. ensuring it is firmly fixed) while minimizing the amount of material required for the one or more gaskets.

In some examples, the top surface contains multiple holes or apertures, and is configured to provide several receptacle areas within the frame materials, for example by attachment of multiple bags. In some examples, multiple holes are used to provide areas for discarding different types of recyclable materials, which may be identified as needed on the top surface or other areas of the receptacle.

In certain embodiments the expanded configuration may define an internal volume of sixty gallons. In some embodiments the expanded configuration may define an internal volume between 40 and 70 gallons, or between 45 and 65 gallons, or between 20 and 50 gallons. In further embodiments the expanded configuration may define an internal volume between 50 and 90 gallons. In certain embodiments the expanded configuration may define an internal volume less than 100 gallons, less than 75 gallons, less than 60 gallons, less than 50 gallons, less than 40 gallons, or less than 30 gallons. In certain other embodiments the expanded configuration may define an internal volume greater than 45 gallons, greater than 35 gallons, or greater than 20 gallons.

In different embodiments, the expanded configuration may have a height between 30" and 45", between 32" and 38", about 37", greater than 32", or less than 48". In some embodiments, the expanded configuration may have a height of 37". In different embodiments the expanded configuration may have a width between 15" and 30", between 20" and 24", about 22", greater than 18", or less than 27". In some embodiments, the expanded configuration may have a width of 22". In some embodiments, the expanded configuration may have a width of 21". In different embodiments the expanded configuration may have a depth between 15" and 30", between 20" and 24", about 22", greater than 18", or less than 27". In some embodiments, the expanded configuration may have a depth of 21". In some embodiments, the expanded configuration may have a depth of 22". In some examples, the depth and width of the expanded configuration may be the same or approximately the same, while in others they may be different.

In different embodiments the collapsed configuration may have a height between 30" and 45", between 32" and 38", about 37", greater than 32", or less than 48". In some embodiments the collapsed configuration may have a height of 37". In different embodiments the collapsed configuration may have a depth between 15" and 30", between 20" and 24", about 22", greater than 18", or less than 27". In some embodiments the collapsed configuration may have a depth of 21". In different embodiments the collapsed configuration may have a depth between 7" and 15", greater than 8", less than 14", or about 10". In some embodiments the collapsed configuration may have a depth of 10.25". In different embodiments the collapsed configuration may have a width between 7" and 15", greater than 8", less than 14", or about 10". In some embodiments the collapsed configuration may have a width of 10.25". In different embodiments the collapsed configuration may have a width between 15" and 30", between 20" and 24", about 22", greater than 18", or less than 27". In some embodiments the collapsed configuration may have a width of 21". In some examples, the collapsed configuration has dimensions appropriate to allow parcel rather than freight shipping. In certain examples, the collapsed configuration lacks any pitch points. Further, examples of the receptacle, in the collapsed configuration, are sized such that a single person may easily transport the receptacle, and allow for more efficient storage thereof In some examples, the collapsed width is less than half the expanded width, in others about 60% or less, about 40% or less, or about 30% or less. In some examples, the collapsed depth is less than half the expanded depth, in others about 60% or less, about 40% or less, or about 30% or less. In certain examples, the collapsed dimension is between about 40-60% of the original dimension, about 40%-50%, about 40-45%, or about 35-45%.

In certain embodiments the front frame piece, rear frame piece, and bottom frame piece may be finished with a powder coat to provide additional beneficial characteristics to the frames. In some embodiments the powder coat may provide water and UV resistance, protection from elements or other forces that are typical or possible in the environment where the waste receptacle may be used, and may allow the wire frames to be more easily cleaned with a damp cloth or otherwise.

These descriptions are merely examples. In certain embodiments, the apparatuses and receptacles may include additional combinations or substitutions of some or all of the components described above. Moreover, additional and alternative suitable variations, forms, features and components will be recognized by those skilled in the art given the benefit of this disclosure. The present disclosure is disclosed above and in the accompanying drawings with reference to a variety of examples and embodiments. The purpose served by the disclosure, however, is to provide examples of the various features and concepts related to the disclosure, not to limit the scope of the disclosure.

What is claimed:

1. A waste receptacle configured to move between a collapsed configuration and an expanded configuration, the receptacle comprising:

a front frame piece comprising a plurality of wires defining a portion of an exterior boundary of the receptacle, wherein the plurality of wires of the front frame piece define at least a front boundary and a portion of two side boundaries of the receptacle;

a rear frame piece comprising a plurality of wires defining a portion of the exterior boundary of the receptacle, wherein the plurality of wires of the rear frame piece define at least a rear boundary and a portion of the two side boundaries of the receptacle;

a bottom frame piece comprising a plurality of wires, wherein the bottom frame piece is configured to be releasably attached to one or more wires of the front frame piece, the rear frame piece, or both;

a first side panel connecting a first side of the front frame and rear frame pieces;

a second side panel connecting a second side of the front frame and rear frame pieces; and a top surface attached to at least a portion of at least one wire of the front frame piece, the rear frame piece, or both, and configured to rotate about the attachment;

wherein when the waste receptacle is in the expanded configuration:

the bottom frame piece is in a first position where it is attached to both the front frame piece and the rear frame piece, such that the bottom frame piece defines at least a lower portion of a side boundary of the receptacle;

the two side panels span a distance between the front frame piece and the rear frame piece to define a portion of the two side boundaries of the receptacle; and the top surface is in a first position where it is attached or adjacent to any top wires of the front frame piece and rear frame piece; and wherein, when the waste receptacle is transitioned to its collapsed configuration:

the top surface is rotated outwardly from its first position to a second position where it is adjacent to an exterior boundary the receptacle;

the bottom frame piece is detached from the one or more wires of the front frame piece or the rear frame piece, and is pivoted inwardly about the attachment of the bottom frame piece to the other of the front frame piece or rear frame piece, from its first position to a second position, and is repositioned in a vertical orientation; and the two side panels are collapsed inwardly, such that the front frame and rear frame pieces may be brought towards each other, such that the two side boundaries are smaller in the collapsed configuration than in the expanded configuration.

2. The waste receptacle of claim 1, wherein the top surface further comprises a solid surface defining an opening such that when the waste receptacle is in the expanded configuration, the opening allows access into an interior of the waste receptacle.

3. The waste receptacle of claim 1, wherein the bottom frame piece is configured to be selectively attached to one or more higher wires of the other of the front frame piece and rear frame piece while in a vertical orientation.

4. The waste receptacle of claim 1, wherein the waste receptacle further comprises one or more gaskets configured to secure a trash bag in the interior of the waste receptacle, wherein the one or more gaskets may be located on the top surface, the front frame piece, the rear frame piece, or a combination thereof.

5. The waste receptacle of claim 1, wherein the front frame piece, the rear frame piece, or both, comprise an exterior powder coat.

6. The waste receptacle of claim 1, wherein the front frame piece defines a generally rectangular front boundary and the rear frame piece defines a generally rectangular rear boundary.

7. The waste receptacle of claim 6, wherein the exterior boundary while the waste receptacle is in the expanded configuration defines a volume that is at least twice that of the volume defined by the exterior boundary while the waste receptacle is in the collapsed configuration.

8. The waste receptacle of claim 7, wherein the front, rear and two side boundaries of the waste receptacle define a generally rectangular interior cavity when the waste receptacle is in the expanded configuration.

9. The waste receptacle of claim 1, wherein the side panels define greater than half but less than the entire width of the side exterior boundaries while in the expanded configuration.

10. The waste receptacle of claim 1, wherein the side panels comprise a single panel with a hinge portion in a middle of the side panel, wherein the hinge portion is configured to collapse inwardly when the front frame piece and the rear frame piece are brought together.

11. A waste receptacle configured to move between a collapsed configuration and an expanded configuration, the receptacle comprising:

a front frame piece comprising at least one wire defining a portion of an exterior boundary of the receptacle;

a rear frame piece comprising at least one wire defining a portion of the exterior boundary of the receptacle;

a bottom frame piece comprising at least one wire, wherein the bottom frame piece is configured to be releasably attached to at least a portion of the front frame piece, the rear frame piece, or both;

a first side panel connecting a first side of the front frame and rear frame pieces;

a second side panel connecting a second side of the front frame and rear frame pieces; and a top surface attached to at least a portion of the front frame piece, the rear frame piece, or both, and configured to rotate about the attachment;

wherein when the waste receptacle is in the expanded configuration:

the bottom frame piece is in a first position where it is attached to both a bottom portion of the front frame piece and a bottom portion of the rear frame piece, such that the bottom frame piece defines at least a lower portion of a side boundary of the receptacle;

the two side panels span a distance between the front frame piece and the rear frame piece to define a portion of two side boundaries of the receptacle;

the top surface is in a first position where it is attached or adjacent to a top portion of the front frame piece and a top portion of the rear frame piece; and wherein when the waste receptacle is transitioned to its collapsed configuration:

the top surface is rotated from its first position to a second position where it is adjacent to the exterior boundary the receptacle;

the bottom frame piece is detached from the bottom portion of the front frame piece or the bottom portion of the rear frame piece, and is pivoted about the attachment of the bottom portion of the frame piece to the other of the bottom portion of the front frame piece or the bottom portion of the rear frame piece, from its first position to a second position, and is reattached in a vertical orientation to one or more top portions of the other of the front frame piece or rear frame piece; and the two side panels are collapsed inwardly, such that the front frame and rear frame pieces may be brought towards each other along an axis between the front and rear frame pieces such that the two side exterior boundaries are smaller in the collapsed configuration than in the expanded configuration.

12. The waste receptacle of claim 11, wherein the at least one wire of the front frame piece defines at least the front boundary of the exterior boundary and a portion of the two side boundaries of the exterior boundary.

13. The waste receptacle of claim 11, wherein the at least one wire of the rear frame piece defines at least the rear boundary of the exterior boundary and a portion of the two side boundaries of the exterior boundary.

14. The waste receptacle of claim 11, wherein the at least one wire of the front frame piece and the at least one wire of the rear frame piece comprise one or more metals or metallic alloys.

15. The waste receptacle of claim 11, wherein the front frame piece, the rear frame piece, and the bottom frame piece comprise a plurality of wires.

16. The waste receptacle of claim 11, wherein the top surface comprises a solid surface defining an opening such that when the waste receptacle is in the expanded configuration, the opening allows access into the interior of the waste receptacle.

17. The waste receptacle of claim 16, wherein the top surface further comprises one or more gaskets configured to secure a trash bag in the interior of the waste receptacle when the waste receptacle is in the expanded configuration.

18. The waste receptacle of claim 11, wherein the side panels define greater than half but less than the entire width of the side exterior boundaries while in the expanded configuration.

19. The waste receptacle of claim 11, wherein the waste receptacle further comprises one or more gaskets, wherein the one of more gaskets may be located on the top surface, the front frame piece, the rear frame piece, or a combination thereof.

20. A waste receptacle configured to move between a collapsed configuration and an expanded configuration, the receptacle comprising:

a front frame piece comprising at least one wire defining a portion of an exterior boundary of the receptacle;

a rear frame piece comprising at least one wire defining a portion of the exterior boundary of the receptacle;

a bottom frame piece comprising at least one wire, wherein the bottom frame piece is configured to be releasably attached to one or more wires of the front frame piece, the rear frame piece, or both;

a first side panel connecting a first side of the front frame and rear frame pieces;

a second side panel connecting a second side of the front frame and rear frame pieces; and a top surface attached to at least a portion of at least one wire of the front frame piece, the rear frame piece, or both, and configured to rotate about the attachment;

wherein when the waste receptacle is in the expanded configuration:

the bottom frame piece is in a first position where it is attached to both the front frame piece and the rear frame piece, such that the bottom frame piece defines at least a lower portion of a side boundary of the receptacle;

the two side panels span a distance between the front frame piece and the rear frame piece to define a portion of two side boundaries of the receptacle;

the top surface is in a first position where it is attached or adjacent to any top wires of the front frame piece and rear frame piece; and wherein when the waste receptacle is transitioned to its collapsed configuration:

the top surface is rotated outwardly from its first position to a second position where it is adjacent to the exterior boundary the receptacle;

the bottom frame piece is detached from the one or more wires of the front frame piece or the rear frame piece, and is pivoted inwardly about the attachment of the bottom frame piece to the other of the front frame piece or rear frame piece, from its first position to a second position, and is reattached in a vertical orientation to one or more higher wires of the other of the front frame piece or rear frame piece;

and the two side panels are collapsed inwardly, such that the front frame and rear frame pieces may be brought towards each other along an axis between the front and rear frame pieces such that the two side boundaries are smaller in the collapsed configuration than in the expanded configuration.

* * * * *